United States Patent [19]

Hammond

[11] 4,114,878

[45] Sep. 19, 1978

[54] ANCHORED GOLF TEE

[76] Inventor: Robert Louis Hammond, 1051 S. Santa Fe Ave., Vista, Calif. 92083

[21] Appl. No.: 812,905

[22] Filed: Jul. 5, 1977

[51] Int. Cl.[2] ..... A63B 69/36; A63B 57/00

[52] U.S. Cl. ..... 273/32 A; 273/32 B; 273/208; 273/183 A

[58] Field of Search ..... 273/208, 198, 183 A, 273/32 B, 33, 32 R, 32 A

[56] References Cited

U.S. PATENT DOCUMENTS

| | | | |
|---|---|---|---|
| 1,552,991 | 9/1925 | Jones | 273/208 |
| 2,668,710 | 2/1954 | Carlson | 273/208 |
| 3,070,068 | 12/1962 | Chapman | 273/208 X |
| 3,744,801 | 7/1973 | Morritt | 273/183 A |
| 3,763,515 | 10/1973 | Voss | 273/32 B X |
| 3,774,913 | 11/1973 | Dien | 273/32 B X |

FOREIGN PATENT DOCUMENTS

| | | | |
|---|---|---|---|
| 278,551 | 10/1927 | United Kingdom | 273/33 |
| 1,202,571 | 8/1970 | United Kingdom | 273/183 A |

*Primary Examiner*—George J. Marlo
*Attorney, Agent, or Firm*—Brown & Martin

[57] ABSTRACT

A golf tee is provided with an anchor in the form of a green groomer secured to the golf tee by means of a high tensile strength flexible line. The groomer also carries a ball marker disc detachably secured thereto by detent type pin and hole attaching device.

7 Claims, 4 Drawing Figures

ANCHORED GOLF TEE

BACKGROUND OF THE INVENTION

The present invention relates to golf accessories and pertains particularly to a golf tee having anchoring means.

Many golfers after teeing off a game of golf or at a practice range fail to pick up their tees. Many golfers fail to pick up the tee simply because they cannot be bothered to do so. Others fail to pick them up because the tee is frequently struck during the hitting of the ball knocking the tee into the grass several yards in front of the golfer. This requires a search for the tee.

Failure to pick up the tee results in loss of tees for those who would ordinarily pick them up. While the expense of tees is not that great, the accumulation over the years of lost tees can be substantial. The tees also accumulate as debris on the golf course or range and become unsightly.

Accordingly, it is desirable that some means be available for reducing the loss of tees and for encouraging the retrieval or picking up thereof.

SUMMARY AND OBJECTS OF THE INVENTION

Accordingly it is the primary object of the invention to overcome the problems of the prior art.

Another object of the present invention is to provide anchoring means for a golf tee so that the tee remains substantially in position after being struck by the golf club.

A still further object of the present invention is to provide a combination of golf tee and green groomer connected together to thereby enhance the utility of both implements.

In accordance with the primary aspect of the present invention, a golfing tee is provided with anchoring means in the form of a green groomer connected thereto by a flexible high tensile cord such that the green groomer serves as an anchor for the golfing tee and the tee likewise serves as a convenient handle for the green groomer.

BRIEF DESCRIPTION OF THE DRAWING

The above and other objects and advantages of the present invention will be apparent from the following description when read in conjunction with the drawings, wherein.

DETAILED DESCRIPTION OF A PREFERRED EMBODIMENT

Figure 1:
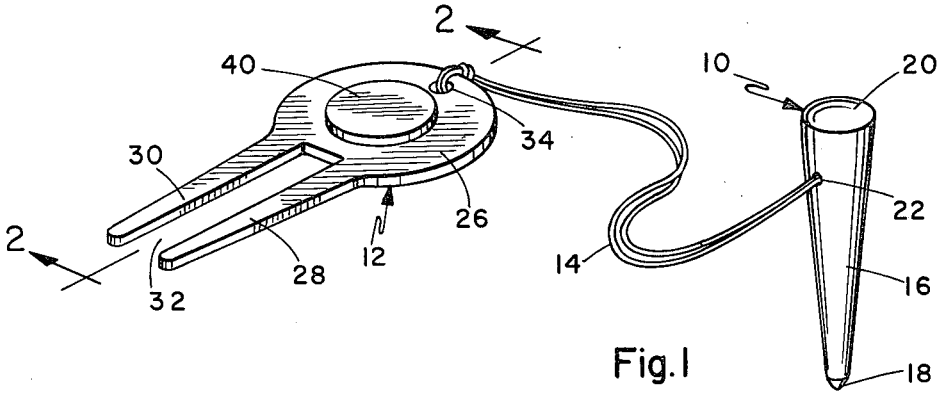
FIG. 1 is a perspective view of the golf tee and green groomer combination in accordance with the invention.

Turning now to the drawings, particularly FIG. 1, there is illustrated a combination in accordance with the present invention of a golf tee designated generally by the numeral 10, anchored by means of a green groomer designated generally by the numeral 12 and connected together by means of a high tensile flexible cord 14. The combination as will be described enhances the utilization or utility of both of the implements of the golfer.

For example, the green groomer serves as an anchor for the tee and at the same time the tee serves as a handle for the green groomer.

Figure 3:
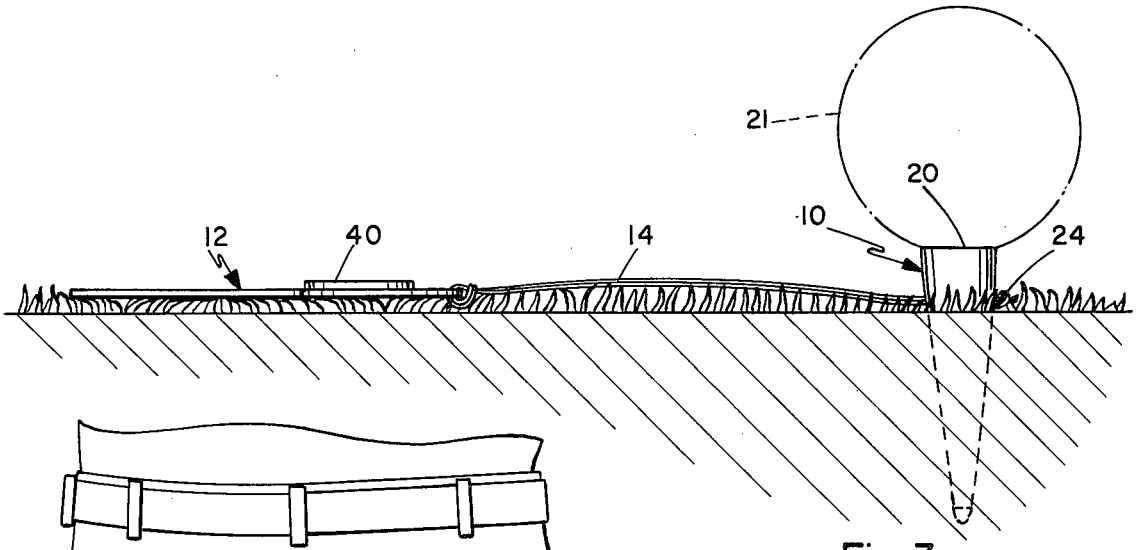
FIG. 3 shows the golf tee in use anchored by the green groomer.

The tee 10 may be of any suitable conventional design and comprises a generally tapered body 16 having a point 18 and a disc shape cup or cap 20 on which is rested a golf ball 21, as shown in phantom in FIG. 3, for the purposes of supporting the ball. The tee 10 may be shaped in a substantially tapered form as shown or may be of more conventional slim shank configuration. The tee may also be constructed of either wood or plastic. In the illustrated combination, the tee is of wood for example, and the line or cord 14 is connected thereto by inserting the ends of the cord through a hole 22 to the body of the tee. The ends of the cord 14 may then be knotted as shown in FIG. 3 at 24 for the purposes of securing the cord or line securely to the tee.

The cord is preferably for convenience, doubled and looped as shown with the two ends secured to the tee and the end or loop portion thereof looped through a hole in the groomer 12 and the remainder of the line or the cord and the tee extended through the loop to detachably connect the tee and groomer together. This manner of connection permits broken tees to be conveniently removed or detached from the groomer and a new tee attached thereto.

When the tee is constructed of plastic the cord or line can be conveniently molded directly into the tee during the molding operation. However, for wooden tees the illustrated manner of connection is possibly most convenient.

The anchor for the tee is preferably a green groomer designated by the numeral 12. The green groomer may have any suitable configuration, but in the preferred embodiment comprises a generally disc shaped body member 26 having a pair of legs defined by, or a pair of prongs extending outward therefrom, 28 and 30 separated by a space 32. Such groomers are typically utilized for repairing a green which may become damaged by a ball striking the green or by the golfer walking on the green. The prongs 28 and 30 are used to probe, rake or otherwise treat the turf in order to return it to as close as is possible to its original condition.

The body 26 of the groomer preferably is formed with a bore or aperture 34 therethrough, positioned opposite the prongs or legs 28 and 30. This hole close to the edge of the disc shaped body provides convenient means as illustrated in FIG. 2 for connection of the line or cord 14 to the body portion 26.

The green groomer preferably has a mass sufficiently exceeding that of the golf tee to essentially serve as anchor therefor. The mass of the groomer, for example, should be anywhere from at least twice to several times the mass of the tee. The anchoring thereof is carried out simply by placing the green groomer on the ground as shown in FIG. 3 when the tee is pressed down into the ground for support of the ball as illustrated in FIG. 3. The weight of the groomer is sufficiently in excess of that of the tee, that impact of the tee of the golfer will not displace the tee more than a few inches or at most a couple of feet from its original position. The groomer thus acts essentially as an anchor or brake on the tee. The tee can then be conveniently retrieved.

Figure 2:
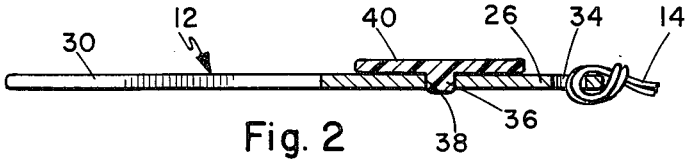
FIG. 2 is an enlarged sectional view taken on line 2—2 of FIG. 1.

Also, as illustrated in FIG. 2, the main body of the green groomer serves also as a convenient mounting means and support means for a ball marker 40. The ball marker is a disc with a shaft or pin 36 substantially concentric therewith, extending into a bore or hole 38 formed substantially in the center of the body 26. Preferably an interference fit exists between the pin 36 and the hole 38. The pin can be made larger at the center with the hole smaller at the center to provide a detent like connection.

The marker can also be held or mounted on the groomer by a magnet. Such a magnet (not shown) could be imbeded in the marker disc and would attach to the metal groomer. Other means for mounting are also possible.

Figure 4:
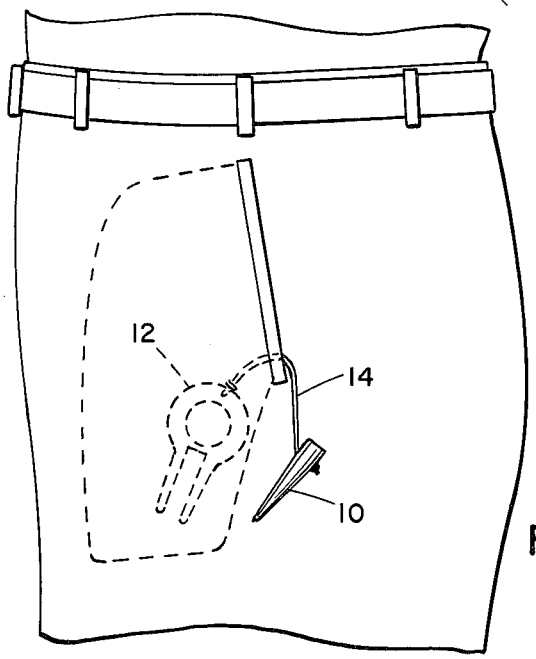
FIG. 4 illustrates how the device is carried in pocket for ease of access.

An additional feature of the combination is illustrated in FIG. 4, which shows the cord 14 and tee 10 serving as a convenient carrying handle or means for the green groomer. Thus the groomer may be simply placed in a pocket of the trousers of a golfer as shown in FIG. 4, permitting the tee to hang outside the pocket. When the golfer desires to use the groomer or the tee he may simply grasp the tee outside of his pocket and remove the assembly without the necessity of placing his hands in his pocket to locate any of the items on the apparatus.

This arrangement also lets him pull the assembly from his pocket without getting his trousers dirty around the pockets. With this arrangement he doesn't have to touch his trousers with his dirty hands.

This arrangement enhances safety on the practice range. It eliminates the need for the golfer to go out in front of the other golfers on the practice range to retrieve tees.

While the present invention has been illustrated in the specific embodiments, it is to be understood that numerous changes and modifications may be made therein without departing from the spirit and scope of the invention as defined in the appended claims.

Having described my invention, I now claim:

1. The combination of a golf tee and anchor comprising:

a golf tee, inertial anchor means comprising a green groomer having a mass exceeding that of the tee, wherein said groomer includes a disc shaped body, and a pair of prongs extending from said disc shaped body in the plane thereof, and a high tensile flexible cord connecting said tee to said anchor.

2. The combination of a golf tee and anchor comprising:

a golf tee, anchor means defined by a green groomer having a mass exceeding that of the tee, and including a disc shaped body, and a pair of prongs extending from said disc shaped body, and a high tensile flexible cord connecting said tee to said groomer, a ball marker detachably mounted on said groomer, said marker comprising a disc having means for attachment to the body of said groomer.

3. The combination of claim 2, wherein said groomer body includes a hole adjacent one edge thereof, said flexible cord comprises a loop extending through the hole with said tee and said cord extended through said loop for detachably connecting said cord and tee to said groomer.

4. The combination of claim 3, wherein said tee includes means defining a bore transverse to the axis thereof, and said cord extends through said bore for connecting said groomer and said tee together.

5. The combination of claim 3, wherein said groomer has a mass more than twice that of the tee.

6. The combination of a golf tee and anchor comprising:

a golf tee including means defining a bore transverse to the axis thereof, anchor means defined by a green groomer having a mass exceeding that of the tee, a disc shaped body, and a pair of prongs extending outward therefrom, and a high tensile flexible cord extending through said bore connecting said tee to said anchor, wherein said cord is doubled to define a loop substantially at the center thereof, said loop extending through a hole in the body of said groomer and said cord extending through said loop for detachably connecting said tee to said groomer, and both ends of said cord extending through said bore in said tee and knotted together.

7. The combination of claim 6, wherein said groomer has a mass several times that of the tee.

* * * * *